US006804928B2

(12) United States Patent
Rada

(10) Patent No.: US 6,804,928 B2
(45) Date of Patent: Oct. 19, 2004

(54) METHOD OF REINFORCING THE HOLDING STRENGTH OF AN ANCHORING ELEMENT IN A CONCRETE SLAB

(75) Inventor: Nicolas Rada, Neuilly S/Seine (FR)

(73) Assignee: Alstom, Paris (FR)

( * ) Notice: Subject to any disclaimer, the term of this patent is extended or adjusted under 35 U.S.C. 154(b) by 20 days.

(21) Appl. No.: 10/290,153

(22) Filed: Nov. 8, 2002

(65) Prior Publication Data

US 2003/0089048 A1 May 15, 2003

(30) Foreign Application Priority Data

Nov. 13, 2001 (FR) ..... 01 14652

(51) Int. Cl.[7] ..... E04B 1/00

(52) U.S. Cl. ..... 52/745.21; 52/698; 441/82.1; 441/930

(58) Field of Search ..... 52/745.21, 698; 411/82, 82.1, 82.2, 82.3, 258, 930; 405/244, 259.6

(56) References Cited

U.S. PATENT DOCUMENTS 4,536,417 A * 8/1985 Shimizu ..... 427/140
4,564,315 A * 1/1986 Rozanc ..... 405/259.6
4,614,781 A 9/1986 Hori et al.
5,965,635 A * 10/1999 Rancich et al. ..... 523/176
6,200,678 B1 * 3/2001 Hunt et al. ..... 428/371
6,228,207 B1 * 5/2001 Rancich et al. ..... 156/327

FOREIGN PATENT DOCUMENTS

GB 609 485 A 10/1948
GB 641 451 A 8/1950
GB 943 090 A 11/1963
JP 63-223216 * 9/1988 ..... 405/262
JP 3-285882 * 12/1991

OTHER PUBLICATIONS

US Patent Application Publication No 20030181571A1 to Kish et al.; published Sep. 25, 2003.*

* cited by examiner

*Primary Examiner*—Ramon O Ramirez
(74) *Attorney, Agent, or Firm*—Sughrue Mion, PLLC

(57) ABSTRACT

A method of reinforcing the holding strength of an anchoring element embedded in a concrete slab is provided. The method includes the steps of: providing the anchoring element; providing a mortar that is made up of a resin mixed with sand and cement; coating the anchoring element with the mortar; and casting the concrete slab around the anchoring element after the anchoring element is coated.

4 Claims, 1 Drawing Sheet

METHOD OF REINFORCING THE HOLDING STRENGTH OF AN ANCHORING ELEMENT IN A CONCRETE SLAB

The invention relates to a method of reinforcing the holding strength of an anchoring element embedded in a concrete slab. The method of the invention serves in particular to improve the holding strength of anchoring elements for fixing base plates supporting the rails of a rail track laid on a concrete slab.

BACKGROUND OF THE INVENTION

Document FR 2 425 014 discloses anchoring elements that are embedded directly in a concrete slab and that make it possible to fix a rail of a rail track, each of those anchoring elements being constituted by an anchoring sheath having a metal outside casing provided with multiple beading and by an anchor screw that screws into the anchoring sheath.

Such anchoring elements are usually embedded in the slab merely by casting the concrete around the anchoring element under gravity. However, it is often difficult to obtain good contact between the concrete and the anchoring element due, for example, to air bubbles forming at the interface between the anchoring element and the concrete, or when the surface state of the anchoring element makes it impossible for good adhesion to be obtained naturally between the concrete and the element, or else when a phenomenon of repulsion occurs because of the texture and of the nature of the materials in contact, as happens in particular when the anchoring element is galvanized or passivated, which limits the holding strength with which the anchoring element is held in the concrete slab. For a rail track, it is important for the anchoring elements to be held firmly in the concrete slab in order to guarantee excellent holding of the rails of the rail track.

OBJECTS AND SUMMARY OF THE INVENTION

An object of the present invention is to provide a method of reinforcing the holding strength with which an anchoring element is held in a concrete slab, which method is simple and inexpensive to implement.

To this end, the invention provides a method of reinforcing the holding strength of an anchoring element embedded in a concrete slab, wherein, prior to casting the concrete slab around the anchoring element, the anchoring element is coated with a mortar that is made up of a resin mixed with sand and cement.

According to another characteristic of the invention, the resin is an ethylene vinyl acetate polymer.

According to another characteristic of the invention, the anchoring element is constituted by an anchoring sheath receiving an anchor screw, and having a galvanized metal outside casing.

According to yet another characteristic of the invention, the anchoring element is used for fixing a rail track.

BRIEF DESCRIPTION OF THE DRAWING

The objects, features, and advantages of the present invention will be better understood on reading the following description of a particular implementation of the invention given by way of non-limiting example, and with reference to accompanying FIG. 1 which is a section view of an anchoring element embedded in a concrete slab by implementing the method of the invention.

MORE DETAILED DESCRIPTION

Figure 1:
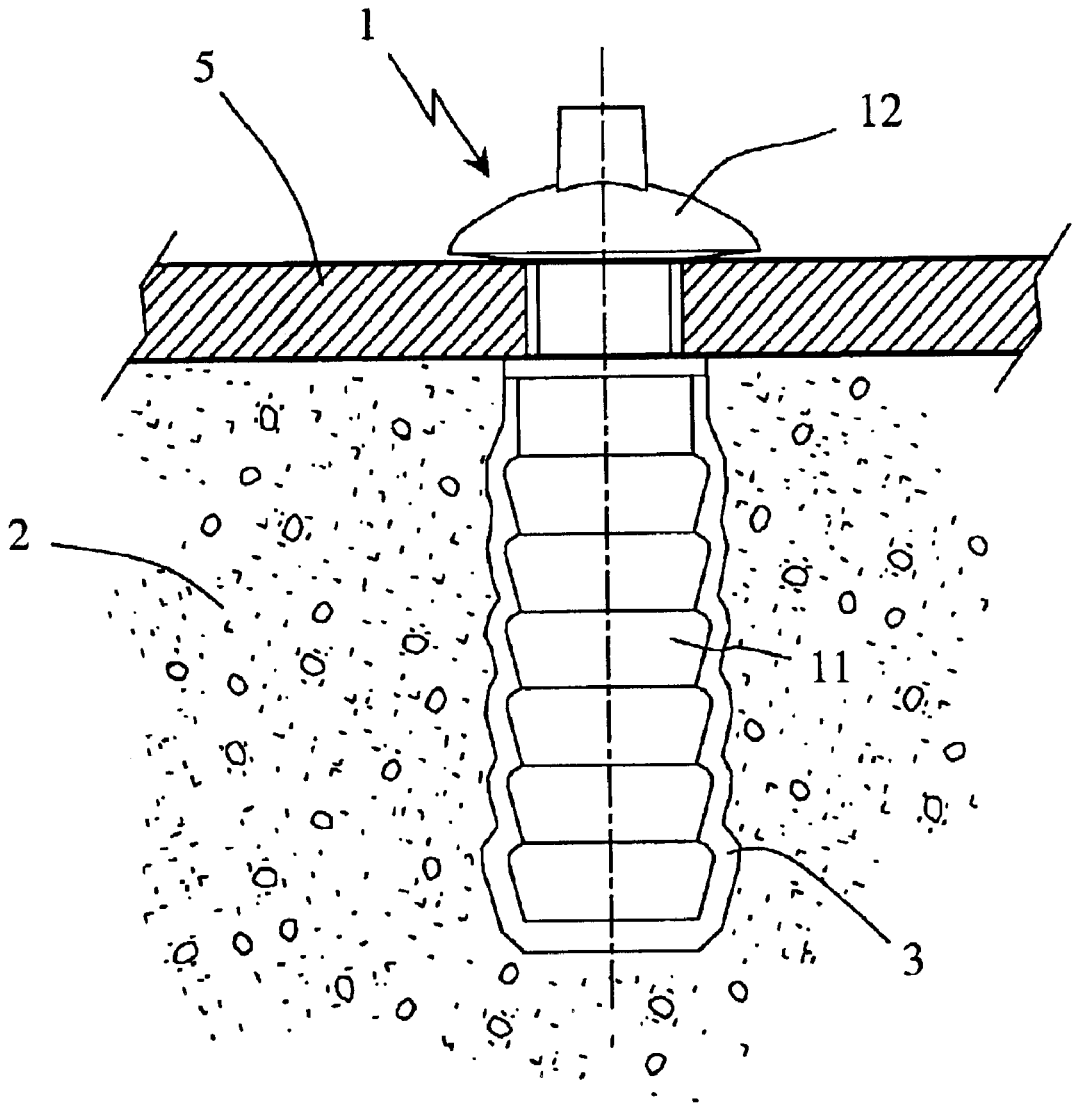

To make the FIGURE clearer, only those elements which are necessary to understand the invention are shown.

FIG. 1 shows an anchoring element embedded in a concrete slab 2 in a particular implementation of the method of the invention.

As shown in the FIGURE, the anchoring element 1 comprises an anchoring sheath 11 which is known per se, and in which an anchor screw or "rail screw" 12 is screwed, the rail screw 12 serving to secure the base 5 of a base plate serving to support a rail of a rail track (not shown in the FIGURE). The anchoring sheath 11 has a metal outside casing that is galvanized and passivated.

In the invention, prior to casting the concrete slab 2, the casing of the anchoring sheath 11 is covered with a mortar 3 made up of a resin mixed with sand and cement. The resin used is preferably an ethylene vinyl acetate polymer.

This mortar 3 is advantageously applied to the anchoring sheaths 11 in an independent operation performed a good while before the concrete slab 2 is cast, so that the mortar 3 is properly dry while the anchoring sheaths 11 are being handled and while the concrete slab 2 is being cast.

For example, the concrete slab 2 may be obtained merely by casting the concrete under gravity into shuttering, the concrete flowing around the mortar 3 covering the anchoring sheath 11, which sheath is held in a fixed position during this operation.

Such a method makes it possible to obtain a significant improvement in the holding strength of the anchoring sheath in the concrete slab by means of the very good cohesion that exists between the mortar and the galvanized metal casing of the anchoring sheath, and between the mortar and the concrete.

Naturally, the invention is in no way limited to the implementation described and shown, which is given merely by way of example. Modifications remain possible, in particular concerning the make up of the various elements, or the use of equivalent substitute techniques, without going beyond the scope of protection of the invention.

Thus, the invention is also applicable to other types of anchoring element and, in particular, it may be used for reinforcing the strength of an anchoring rod that is substantially smooth, that is designed to be embedded directly in a concrete slab, and that has a threaded top portion projecting from the concrete slab and serving to receive fixing parts for fixing the rail track, and for enabling them to be secured by means of a nut.

What is claimed is:

1. A method of reinforcing the holding strength of an anchoring element embedded in a concrete slab, comprising:

providing the anchoring element;

providing a mortar that is made up of a resin mixed with sand and cement;

coating the anchoring element with the mortar allowing the mortar to dry; and casting the concrete slab around the anchoring element after the anchoring element is coated.

2. A method according to claim 1, wherein the step of providing a mortar that is made up of a resin mixed with sand and cement includes providing a resin that is an ethylene vinyl acetate polymer.

3. A method according to claim 1, wherein the step of providing the anchoring element includes providing an anchoring element being constituted by an anchoring sheath receiving an anchor screw and having a galvanized metal outside casing.

4. A method according to claim 1, including the step of fixing a rail track using the anchoring element.

* * * * *